United States Patent [19]

Watson et al.

[11] 4,206,602

[45] Jun. 10, 1980

[54] SINGLE LEVER HYDRAULIC SYSTEM CONTROL MECHANISM

[75] Inventors: Gary E. Watson, Mequon; Edward A. Simi, Menomonee Falls; Richard R. Miller, Milwaukee, all of Wis.

[73] Assignee: Douglas Dynamics, Inc., Milwaukee, Wis.

[21] Appl. No.: 31,401

[22] Filed: Apr. 19, 1979

[51] Int. Cl.[2] ..... F15B 13/06; F15B 21/08; G05G 9/00

[52] U.S. Cl. ..... 60/433; 60/484; 60/DIG. 2; 74/471 XY; 91/521

[58] Field of Search ..... 74/471 XY; 91/521, 522; 60/433, 484, DIG. 2

[56] References Cited

U.S. PATENT DOCUMENTS

| | | | |
|---|---|---|---|
| 3,056,867 | 10/1962 | Eitel | 200/81 |
| 3,091,130 | 5/1963 | Payerle et al. | 74/471 |
| 3,517,568 | 6/1970 | Payerle | 74/471 |
| 3,541,876 | 11/1970 | Gressard | 74/471 |
| 3,541,877 | 11/1970 | Houk | 74/471 |
| 3,585,319 | 6/1971 | Payerle | 74/471 XY X |
| 3,786,689 | 1/1974 | Houk | 74/471 XY |
| 4,026,048 | 5/1977 | Hill et al. | 37/42 R |

*Primary Examiner*—Edgar W. Geoghegan
*Attorney, Agent, or Firm*—Michael, Best & Friedrich

[57] ABSTRACT

More specifically, the invention includes a single lever control mechanism for controlling the operation of hydraulic cylinders and including a control housing, a manually operable lever, and a support member housed in the control housing and having a supporting surface. The single lever control mechanism also includes a pivot member rigidly connected to the lower end of the lever and supported on the supporting surface of the support member for rocking movement from a neutral position in a first pivotal direction and in a second pivotal direction transverse to the first direction. The control mechanism also includes a first cable attached to one side of the pivot member and being adapted to be operably connected to a first hydraulic cylinder for actuating that hydraulic cylinder in response to pivotal movement of the lever and the pivot member in the first direction. The control member also includes a second cable attached to another side of the pivot member, transverse to the one side of the pivot member, and being adapted to be operably connected to a second hydraulic cylinder for actuating that hydraulic cylinder in response to pivotal movement of the lever and the pivot member in the second direction.

16 Claims, 10 Drawing Figures

SINGLE LEVER HYDRAULIC SYSTEM CONTROL MECHANISM

FIELD OF THE INVENTION

The invention relates to a single lever hydraulic system control mechanism of the type wherein one or more hydraulic cylinders and other related hydraulic fluid supply apparatus can be controlled by a single lever. The invention also relates to a single lever hydraulic control mechanism for use in combination with a plow blade adapted to be mounted on a vehicle, and for effecting positioning movement of the blade.

BACKGROUND PRIOR ART

Single lever control mechanisms of the type of the invention are shown in the U.S. Hauk Pat. No. 3,786,689, issued Jan. 22, 1974; in the U.S. Payerle Pat. 3,585,319, issued June 15, 1971; and in the U.S. Gressard Pat. 3,541,876, issued Nov. 24, 1970.

Attention is also directed to the U.S. Hauk Pat. 3,541,877, issued Nov. 24, 1970; the U.S. Payerle Pat. 3,517,568, issued June 30, 1970; and the U.S. Payerle Pat. No. 3,091,130, issued May 28, 1963.

Finally, attention is directed to the U.S. Eitel Pat. 3,056,867, issued Oct. 2, 1962; and the U.S. Hill et al Pat. No. 4,026,048, issued May 31, 1977.

BRIEF SUMMARY OF THE INVENTION

The present invention provides an improved single lever control mechanism for use with a hydraulic system for controlling operation of that hydraulic system.

More specifically, the invention includes a single lever control mechanism for controlling the operation of hydraulic cylinders and including a control housing, a manually operable lever, and a support member housed in the control housing and having a supporting surface. The single lever control mechanism also includes a pivot member rigidly connected to the lower end of the lever and supported on the supporting surface of the support member for rocking movement from a neutral position in a first pivotal direction and in a second pivotal direction transverse to the first direction. The control mechanism also includes a first cable attached to one side of the pivot member and being adapted to be operably connected to a first hydraulic cylinder for actuating that hydraulic cylinder in response to pivotal movement of the lever and the pivot member in the first direction. The control member also includes a second cable attached to another side of the pivot member, transverse to the one side of the pivot member, and being adapted to be operably connected to a second hydraulic cylinder for actuating that hydraulic cylinder in response to pivotal movement of the lever and the pivot member in the second direction.

One of the features of the invention is the provision in the single lever control mechanism of an electrically driven pump operably connected to the hydraulic cylinders and switch means for selectively actuating the electrically driven pump in response to movement of the control lever. The switch means includes a fixed contact supported by the support member and a movable contact supported on the pivot member, the movable contact being selectively engageable with the fixed contact when the pivot member is moved from the neutral position to a second position.

Another of the principal features of the invention is the provision in the single lever control mechanism of means for biasing the pivot member to the neutral position, the biasing means including a helical compression spring between the upper wall of the housing and the pivot member.

Another of the principal features of the invention is the provision in the single lever control mechanism of means for selectively preventing movement of the lever including a locking spool supported on the lever for slidable longitudinal movement from a first position spaced from the upper wall of the control mechanism housing wherein the lever is freely movable to a second position wherein at least a portion of the spool is fixedly housed in a cruciform opening in the housing upper wall to preclude movement of the lever.

Another of the principal features of the invention is the provision of the support member being a pivot post having an upper end supporting the pivot member for pivotal movement and the fixed contact being an electrically conductive collar at least partially surrounding the pivot post and the movable contact including a plurality of contact fingers extending downwardly from a plurality of sides of the pivot member, the contact fingers selectively engaging the collar when the pivot member is pivoted from the neutral position.

The invention also provides the combination of a plow blade, means for controlling vertical movement of the plow blade including a first hydraulic cylinder, means for controlling lateral pivotal movement of the plow blade including a second hydraulic cylinder, and means for supplying hydraulic fluid to the hydraulic cylinders including a fluid pump and an electric motor for actuating the pump. The combination also includes a single lever control mechanism for selectively controlling the operation of the hydraulic cylinders including a control housing, a manually operable lever, a pivot post supported in the control housing and having an upwardly extending free end, and a pivot member rigidly connected to the lower end of the lever and supported on the upper end of the post for rocking movement from a neutral position in a first pivotal direction and in a second pivotal direction transverse to the first direction. The combination further includes a first cable attached to one side of the pivot member, the cable being operably connected to the first hydraulic cylinder for actuating that hydraulic cylinder in response to pivotal movement of the lever and the pivot member in the first direction, and a second cable attached to another side of the pivot member transverse to the one side of the pivot member, the second cable being operably connected to the second hydraulic cylinder for actuating that hydraulic cylinder in response to pivotal movement of the lever and the pivot member in the second direction.

One of the advantages of the invention is embodied in its simplicity of construction, the single lever control mechanism being comprised of relatively few parts, thereby permitting inexpensive assembly and facilitating servicing.

Another of the advantages of the single lever control mechanism is that angular movement of a plow blade controlled by the single lever control mechanism can be accomplished by linear movement of the control lever from left to right rather than by a twisting movement of a control stick as in the structure shown in the U.S. Payerle Pat. No. 3,585,319. Linear movement of the control lever has been found to be commonly preferred by vehicle operators and tends to be less fatiguing.

Another of the advantages of the single lever control mechanism of the invention is that its construction permits the operator to use less force to effect movement of the control cables than is commonly required with other control mechanisms.

Another of the advantages of the construction of the single lever control mechanism embodying the invention is that the control cables associated therewith extend outwardly through the bottom of the control mechanism housing and are generally parallel to the axis of the control lever. As a result, the control mechanism is conveniently mounted on either the floor of the vehicle or on the vehicle dash. The prior art control mechanisms, such as that shown in the Payerle patent cited above, are operative such that the control cables must extend outwardly through a side wall of the control mechanism housing. As a result, mounting of the control mechanism on the vehicle dash becomes difficult.

Another advantage of the invention is that the control mechanism can be adjustably supported such that the position of the control handle can be varied to the preference of the vehicle operator.

Other features and advantages of the invention will be apparent from the following description and claims and from the drawings.

Figure 1:
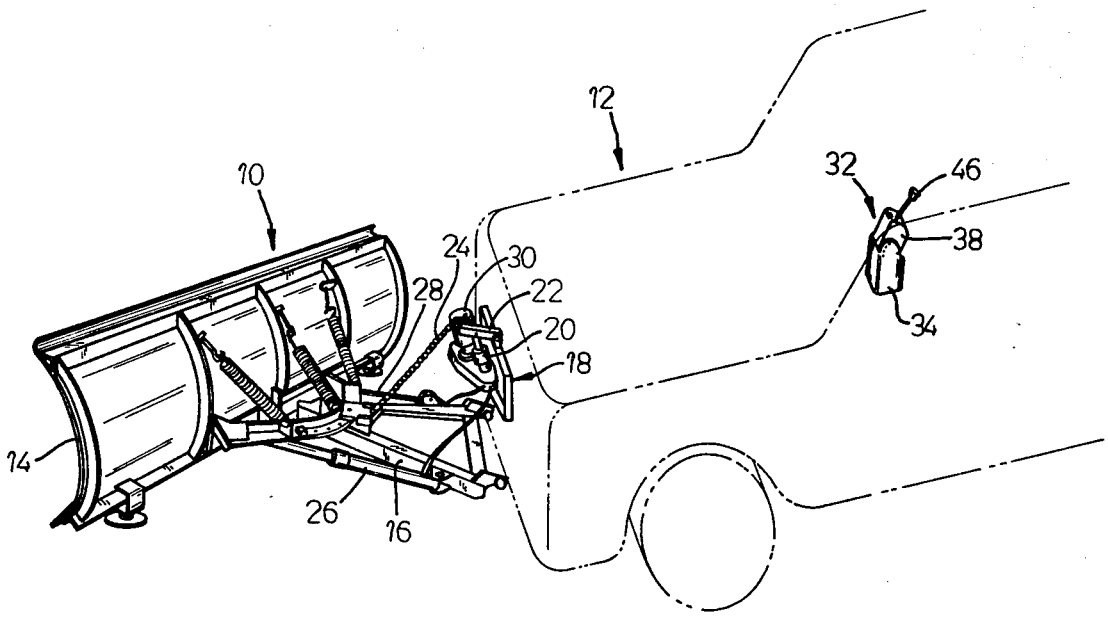
FIG. 1 is a perspective view of a snowplow mounted on a truck provided with a single lever control mechanism embodying the invention.

Before describing at least one embodiment of the invention in detail, it is to be understood that the invention is not limited in its application to the details of construction or the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF PREFERRED EMBODIMENTS

Illustrated in FIG. 1 is a snowplow 10 mounted on a truck 12 (shown in phantom). The snowplow 10 generally includes a plow blade 14 supported for vertical and angular movement by a generally triangular pivotably mounted supporting frame 16 and a support frame 18 fixedly secured to the truck. The rearward portion of the supporting frame 16 is pivotally attached to the truck frame for pivotal movement such that the plow blade 14 can be raised and lowered. The plow blade 14 is attached to the forward portion of the supporting frame 16 for pivotal movement about a vertical axis and such that the plow blade 14 can be pivoted for angular movement. The means for effecting vertical movement of the plow blade 14 includes a hydraulic cylinder 20 supported by the supporting assembly 18, the hydraulic cylinder 20 being connected to a forwardly and upwardly extending pivotal lever 22, the pivotal lever 22 having a free end movable vertically in response to actuation of the hydraulic cylinder 20. A chain 24 is connected between the free end of the vertically movable end of the lever 22 and a forward end of the supporting frame 16. Actuation of the hydraulic cylinder 20 will thus cause vertical movement of the plow blade 14.

The means for effecting angular movement of the plow blade 14 includes a pair of hydraulic cylinders 26 and 28. The hydraulic cylinder 26 is pivotally connected at one of its ends to the support frame 16 at a point adjacent the truck frame, and its opposite end is pivotally connected to the plow blade 14 at a point located to one side of the vertical pivot axis of the plow blade. The other hydraulic cylinder 28 is similarly connected at one of its opposite ends to the frame 16 at a point adjacent the truck frame and is connected at its opposite end to a point on the plow blade 14 located to one side of the vertical pivot axis of the plow blade and opposite the other hydraulic cylinder 26.

The support assembly 18 also supports a hydraulic fluid pump (not shown) driven by an electric motor 30. The hydraulic fluid pump is connected through suitable valves (not shown) to the hydraulic cylinders 20, 26, and 28 such that they can be alternatively and selectively actuated to thereby effect the desired movement of the plow blade 14.

Also shown in FIG. 1 is a single lever control mechanism 32 which is functional to cause actuation of the hydraulic fluid pump electric motor 30 and selective actuation of the valves which control fluid flow from the hydraulic fluid pump to the hydraulic cylinders 20, 26 and 28. As illustrated in FIG. 1, the single lever control mechanism 32 is conveniently mounted in the vehicle cab and can be supported therein by floor mount 34, illustrated in FIG. 2, or beneath the dashboard 35 of the vehicle by a mounting bracket 36, as illustrated in FIG. 3.

Figure 2:
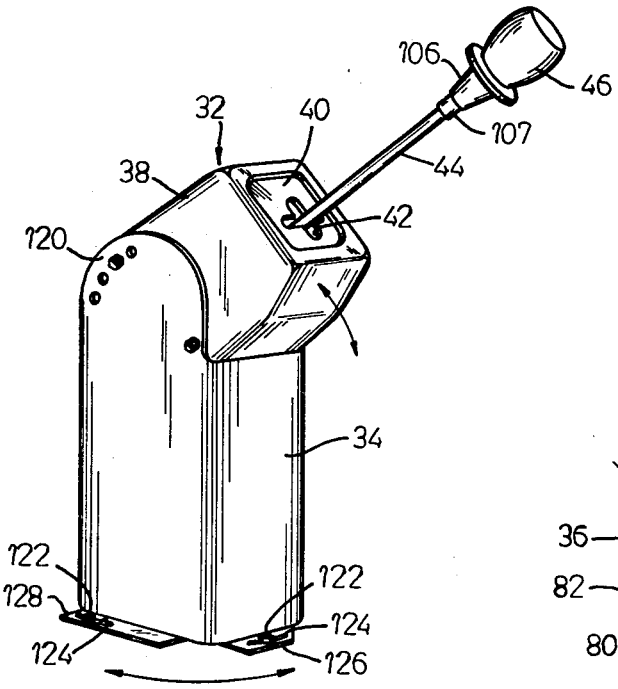
FIG. 2 is an enlarged perspective view of the control mechanism and mounting assembly shown in FIG. 1.
Figure 3:
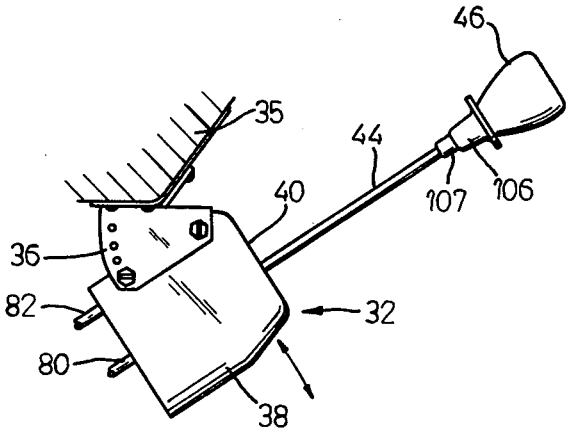
FIG. 3 is a view of the control mechanism shown in FIG. 2 but supported by an alternative mounting bracket.
Figure 4:
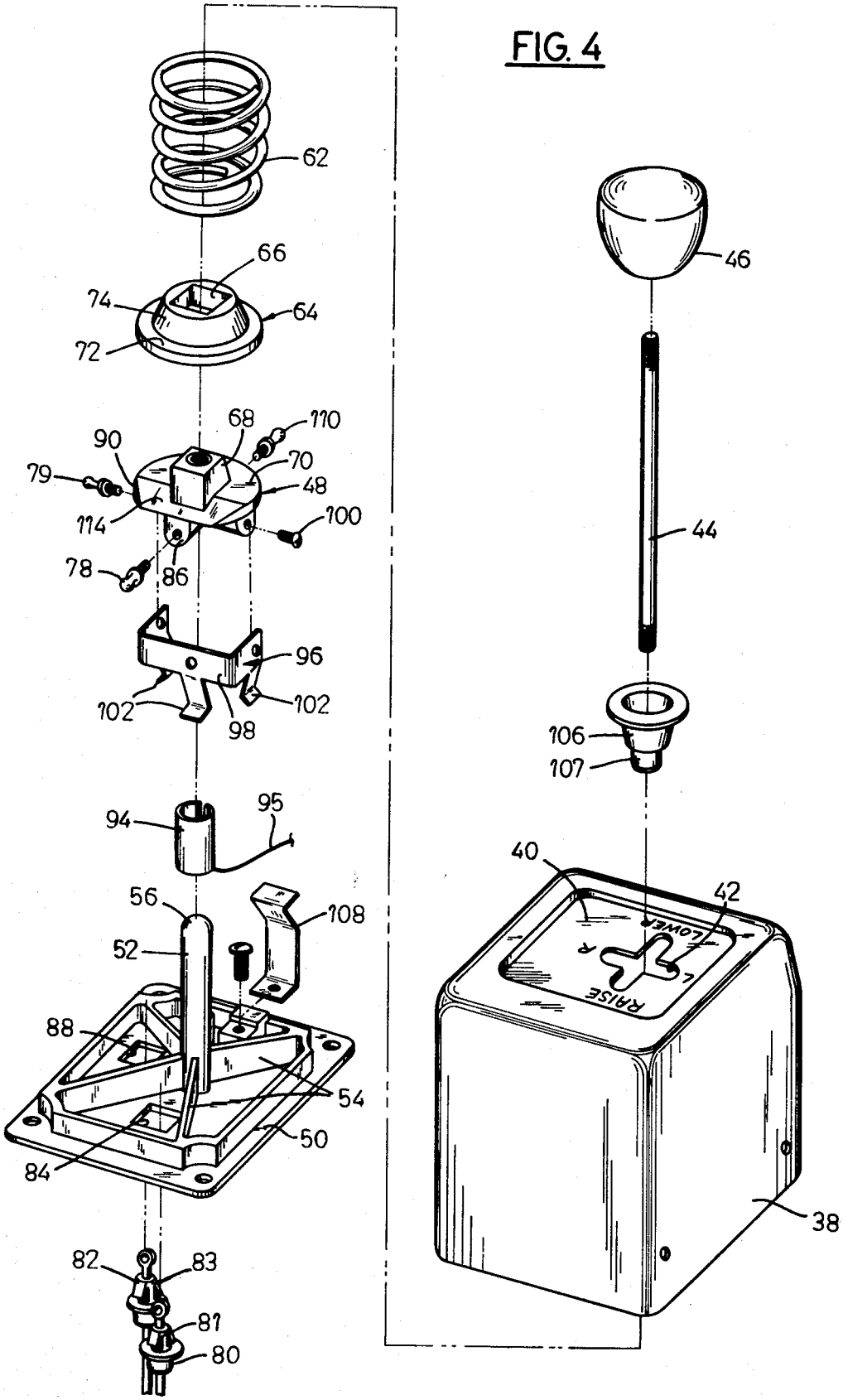
FIG. 4 is an exploded perspective view of the single lever control mechanism embodying the invention.
Figure 8:
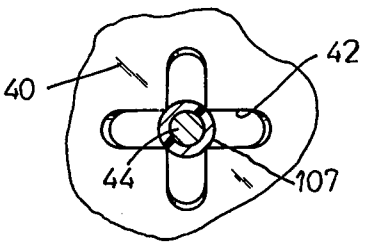
FIG. 8 is a cross section view taken along line 8—8 in FIG. 6.
Figure 6:
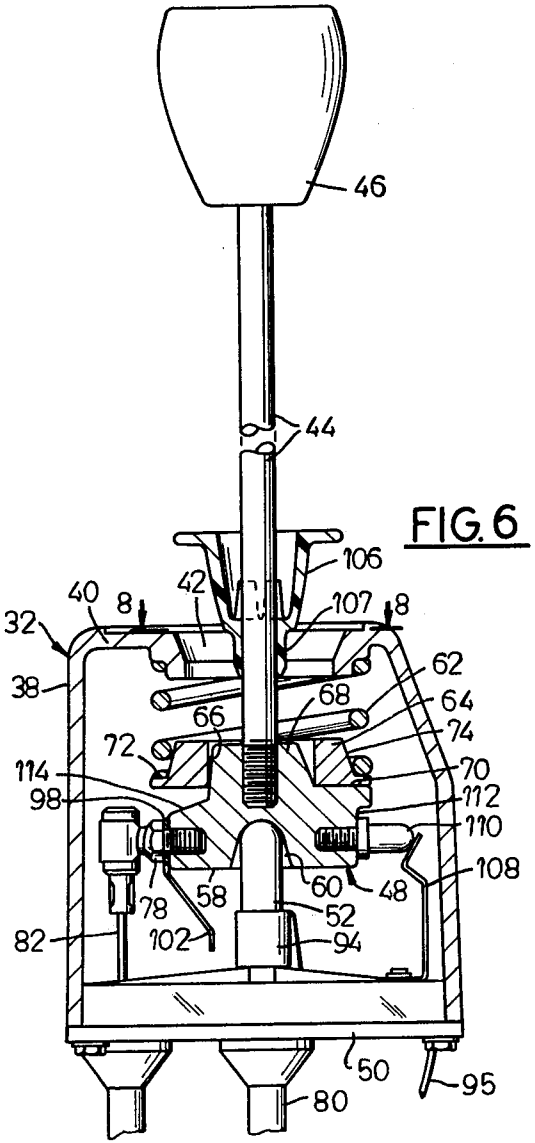
FIG. 6 is a view similar to FIG. 5 but showing the control lever locking spool in a position which prevents movement of the control lever.
Figure 5:
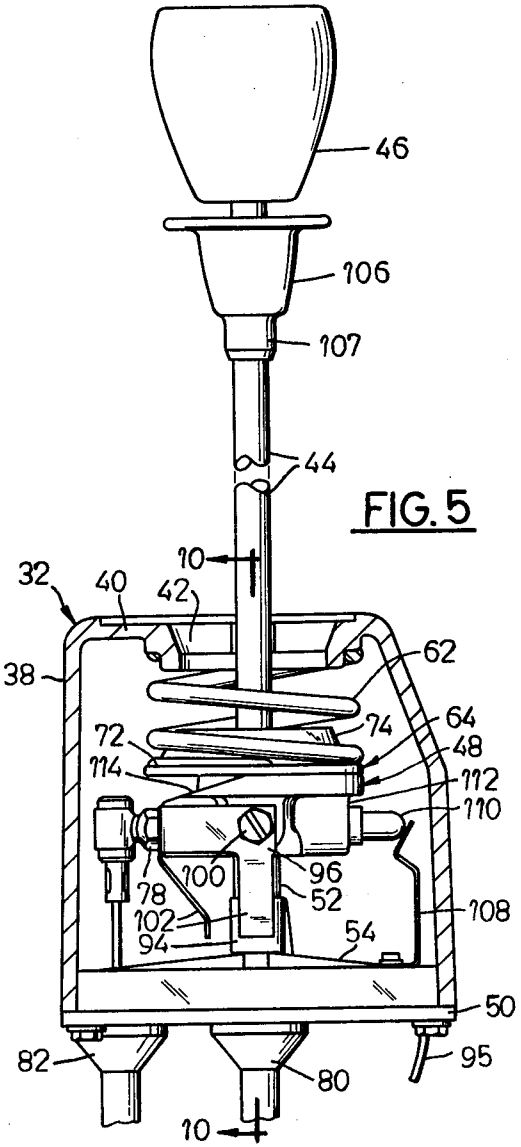
FIG. 5 is a cross section elevation view of the control mechanism shown in FIGS. 1–4 and with the control lever in a neutral position.
Figure 10:
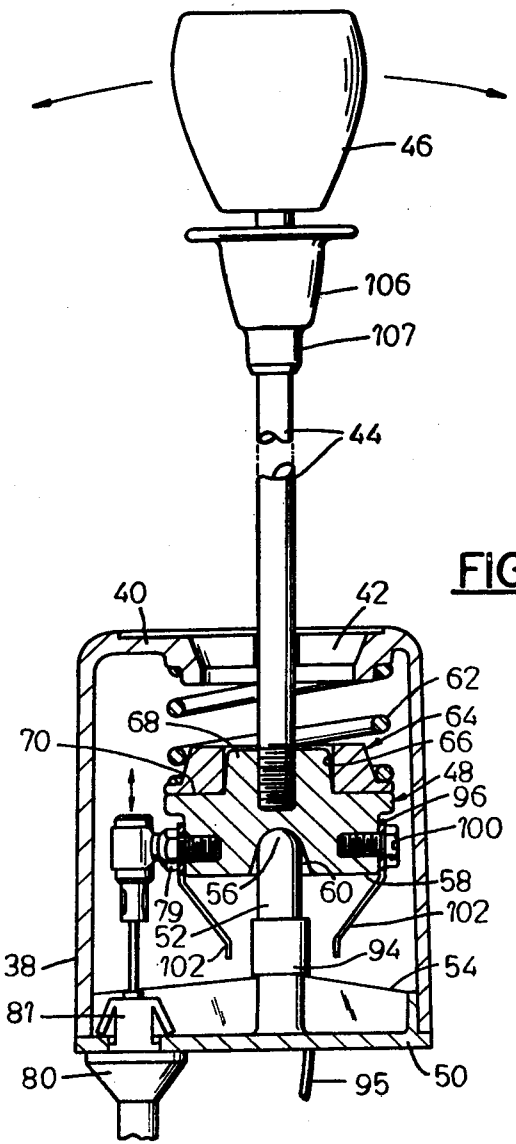
FIG. 10 is a cross section view taken generally along line 10—10 in FIG. 5.

The single lever control mechanism 32 is illustrated in greater detail in FIGS. 4 and 5 and generally includes a housing 38 adapted to be supported by the mount 34 shown in FIG. 2 or the bracket 36 shown in FIG. 3. The housing 38 includes an upper wall 40 having a cruciform opening 42 therethrough. The cruciform opening 42 houses a control lever 44 having a handle or knob 46 attached to its free end. The opposite end of the control lever 44 is threaded into a pivot member 48, shown for example in FIGS. 4–6. The single lever control mechanism 32 also includes a housing base plate 50 secured to the bottom of the housing 38 and supporting a centrally located upwardly projecting pivot post 52. The pivot post 52 is integrally joined at its lower end to the base plate 50 and is also supported by radially extending flanges or buttresses 54, each of the flanges 54 fixedly joined to the pivot post 52 and to the housing base plate 50. The pivot post 52 includes a rounded upper end 56 adapted to pivotally support the pivot member 48. As shown in FIGS. 6 and 10, the lower surface 58 of the pivot member 48 includes a recess 60 therein for housing the rounded upper end 56 of the pivot post 52, the recess 60 having a smooth internal surface complementary to the rounded surface of the upper end of the pivot post 52 and thereby facilitating smooth pivoting of the pivot member 48 and the pivot post 52.

Means are also provided for biasing the pivot member 48 toward a position as illustrated in FIGS. 6 and 10 wherein the control lever 44 is coaxial with respect to the pivot post 52 and perpendicular to the upper wall 40 of the housing 38 and such that the control lever 44 is positioned in the center of the cruciform opening 42. In the illustrated construction, the biasing means includes a helical compression spring or centering spring 62 and a spring retainer or collar 64. The spring retainer 64 includes a central rectangular aperture 66 (FIG. 4) adapted to house an upwardly projecting rectangular lug 68 extending from the upper surface 70 of the pivot member 48. The spring retainer 64 also includes an annular shoulder 72 for supporting the lower end of the centering spring 62, and an upwardly projecting truncated cone portion 74 projecting into the centering spring 62 to maintain alignment of the lower end of the centering spring 62 and the spring retainer 64. The upper end of the centering spring 62 engages the lower surface of the housing upper wall 40.

Figure 7:
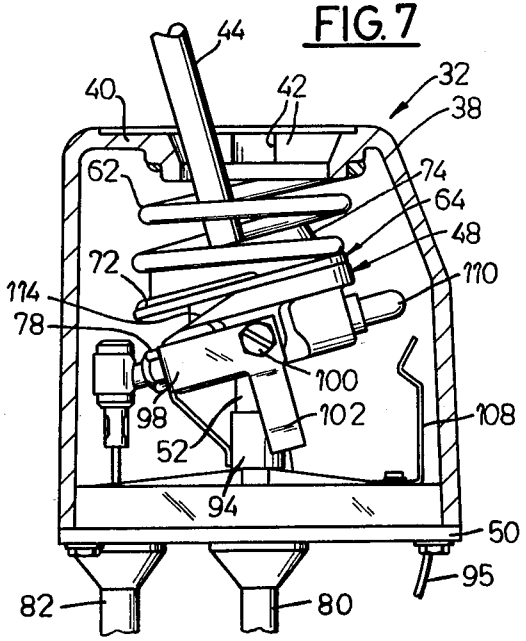
FIG. 7 is a partial view of the control mechanism shown in FIGS. 5 and 6 but with the control lever in a plow raising position.
Figure 9:
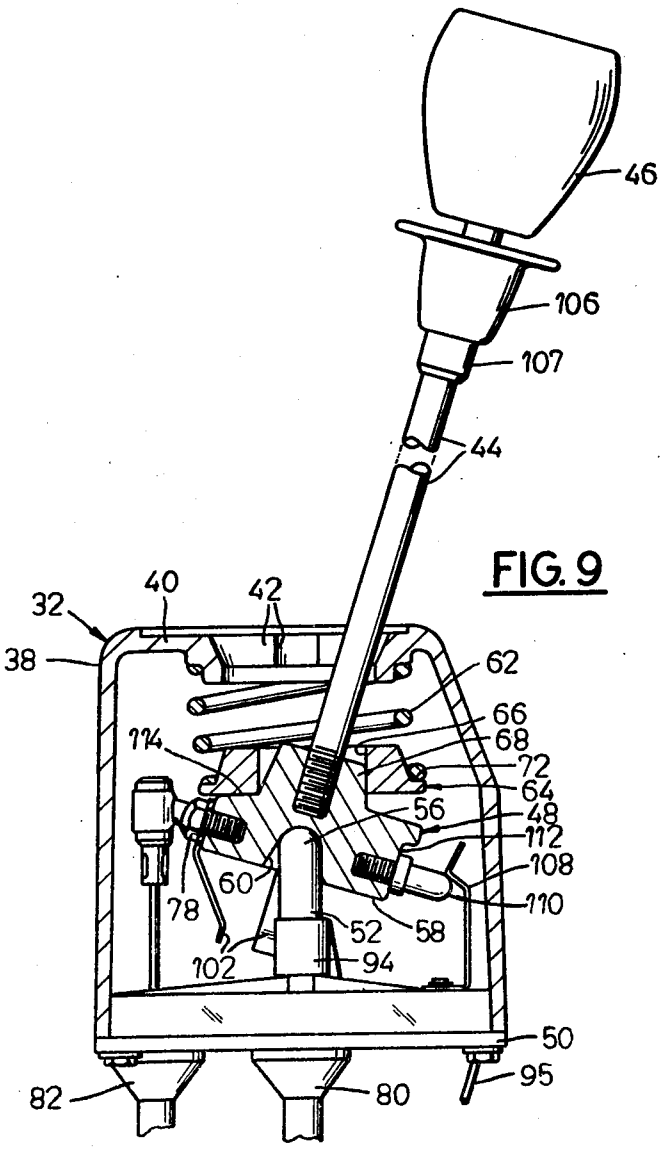
FIG. 9 is a view similar to those in FIGS. 5–7 but showing the control lever in a plow lowering position.

In operation, if, for example, the control lever 44 is pivoted as shown in FIGS. 7 and 9, downward force of the centering spring 62 on the spring retainer 64 and on the upper surface 70 of the pivot member 48 will bias the pivot member 48 back to the central or neutral position shown in FIG. 6 when the lever is released.

The single lever control mechanism also includes a pair of cable connecting pins 78 and 79 extending from the pivot member 48 and adapted to be attached to respective hydraulic valve push-pull control cables 80 and 82. The control cable 80 extends through an aperture 84 in the housing base plate 50 and is adapted to be attached to a ball stud of the cable connecting pin 78 which projects from a front vertical face portion 86 of the pivot member 48. The end of the conduit portions of the control cables 80 and 82 are fixedly joined to the base plate 50 by fittings 81 and 83 which are received in snap fitting relation in the apertures 84 and 88. The opposite end of the control cable 80 is suitably connected to the fluid valves controlling delivery of the hydraulic fluid to the hydraulic cylinder 20 which controls vertical movement of the plow blade 14. Pivotal movement of the control lever 44 from the neutral position to the raise or lower position, causes pivotal movement of the pivot member 48 and consequent vertical movement of the cable connecting pin 78 with respect to the base plate 50 whereby the hydraulic fluid control valve is actuated to supply fluid to or to vent the hydraulic cylinder 20.

The control cable 82 similarly extends through an aperture 88 in the base plate 50 and is connected to the cable connecting pin 79 which extends from the side face 90 of the pivot member 48, the side face 90 being perpendicular to the front face 86. The control cable 82 is suitably connected to the hydraulic control valve which selectively and alternatively actuates the hydraulic cylinders 26 and 28. Movement of the control lever 44 from the neutral or center position to the L and R positions indicated in FIG. 4 will cause pivotal movement of the pivot member 48 on the pivot post 52 and consequent movement of the cable connecting pin 79 toward and away from the base plate 50. As best shown in FIG. 10, such movement of the pivot member 48 and the cable connecting pin 79 will cause consequent movement of the cable core of cable 82 and actuation of the associated hydraulic control valve in such a manner as to effect selective and alternative actuation of the hydraulic cylinders 26 and 28 to thereby vary the angular position of the plow blade 14.

Means are also provided for actuating the electric motor 30 which drives the hydraulic fluid pump in response to movement of the control lever 44 from a neutral position to any of the raise, left or right positions. It should be noted that it is unnecessary to actuate the hydraulic fluid pump when the control lever 44 is moved to a blade lowering position because lowering of the plow blade 14 is accomplished by merely venting the hydraulic cylinder 20 supporting the blade 14. In the illustrated construction, the electric motor actuating means includes a contact sleeve 94 surrounding the pivot post 52 and a contact assembly 96 fixedly attached to the pivot member 48 and adapted to engage the contact sleeve 94 when the control lever 44 and pivot member 48 are pivoted. The contact assembly 96 includes a U-shaped electrically conductive bracket portion 98 secured to the forward surface 86 of the pivot member 48 and the two side surfaces 90 of the pivot member 48 by the two cable connecting pins 78 and 79 and by a screw 100, respectively. The contact assembly 96 also includes three downwardly extending contact blades 102 integral with the contact bracket portion 98 and suitably shaped so as to engage the contact sleeve 94 when the pivot member 48 is pivoted.

The contact sleeve 94 is suitably connected to a solenoid (not shown), functional to actuate the electrical motor 30, by a wire 95, and contact assembly 96 is suitably grounded through the cable connecting pins 78 and 79 and the control cables 80 and 82. As illustrated in FIG. 7, when the control lever 44 is pivoted forwardly to cause the plow blade 14 to be raised, one of the contact blades 102 will engage the contact sleeve 94 and thereby cause actuation of the electric motor 30 driving the hydraulic fluid pump. When the control lever is similarly pivoted to the left or to the right, as shown in FIG. 7, to thereby cause left or right angular movement of the plow blade 14, one of the other contact blades 102 will engage the contact sleeve 94 to actuate the electric motor 30.

Means are also provided for locking the control lever 44 in the neutral position. In the illustrated construction, the locking means includes a locking spool 106 supported on the control lever 44 for slidable longitudinal movement, the locking spool 106 including a lower end 107 which can be wedged into the central portion of the cruciform opening 42 as shown in FIG. 6 to thereby prevent movement of the lever 44.

Means are also provided for releasably restraining the control lever 44 and the pivot member 48 in a position wherein the plow blade 14 is permitted to remain in the lowered position and to freely float vertically. Such free floating is permitted when the control lever is in the position shown in FIG. 9, because the associated hydraulic fluid valve vents the hydraulic cylinder 20 thereby permitting free floating movement of the plow blade 14. The restraining means includes a detent spring 108 which is supported by the housing base plate 50 and which extends upwardly therefrom so as to releasably engage a detent pin 110, the detent pin 110 being similar to the connecting pins 78 and 79 and projecting from the rear surface 112 of the pivot member 48. The detent spring 108 is suitably shaped to engage the upper surface of the detent pin 110 and to apply a downward force on the detent pin 110 when the pivot member 48 is in the plow blade lowering position as shown in FIG. 9. To further facilitate retention of the pivot member 48 in the detent position, the pivot member 48 includes a planar ramp surface 114 adjacent its forward edge, the ramp surface 114 adapted to be parallel to the upper wall of the housing 38 when the pivot member is tilted to the plow blade lowering position as shown in FIG. 9. Accordingly, when the pivot member 48 is in that position, centering spring 62 will not force the pivot member 48 and the control member 44 back to the neutral position.

As previously described, the single lever control mechanism 32 is adapted to be supported by the floor mount 34 illustrated in FIG. 2. One of the advantages of the control mechanism of the invention is that its position is easily adjusted to provide maximum operational convenience to the plow operator. For example, the floor mount 34 includes a pair of upwardly extending planar flanges 120 adapted to selectively support the control housing 38 therebetween in a plurality of vertical angular positions. The floor mount 34 can also be secured to the vehicle floor by a plurality of screws 122 extending through arcuate slots 124 in flanges 126 and 128 which extend outwardly from the base of the floor mount 34. This means of attaching the floor mount 34 to the floor of the vehicle cab permits some angular adjustment of the position of the floor mount 34 and the control mechanism 32 so that the operator can position the control mechanism 32 in such a manner that the control lever 44 is conveniently located. The mounting bracket 36 illustrated in FIG. 3 is also constructed to permit pivotal adjustment of the housing 38 such that the operator can select the desired position of the control lever 44.

In the preferred form of the invention, the housing 38, the base plate 50 and the pivot post 52 integral therewith, as well as pivot member 48, are each constructed from injection molded plastic and form respective one piece integral units. By providing a construction which permits these components to be manufactured in this manner, and by designing the various components of the control mechanism in the manner described above, a single lever control mechanism can be constructed which has a minimal number of components or parts, and manufacture of the structure is facilitated. Furthermore, the use of a limited number of components in the construction of the control mechanism also facilitates maintenance or repair of the control mechanism.

Another of the advantages incident to the construction of the control mechanism as described above, is that the unit may be installed in a wide variety of vehicles. The internal construction of the control mechanism facilitates the projection of the control cables through the base plate 50 rather than through the housing side wall. As a result, the control mechanism can be supported on the floor of the vehicle by floor mount as shown in FIG. 2 or alternatively by a dash mounted bracket as shown in FIG. 3. In similar control mechanisms having control cables projecting from a side of the control housing, the inflexibility of the control cables may prohibit mounting of the control mechanism to the vehicle dash.

Another of the substantial improvements of the control mechanism is that its construction facilitates movement of the control lever 44 in response to a very low force input, thereby substantially limiting operator fatigue.

Various features of the invention are set forth in the following claims.

We claim:

1. A single lever control mechanism for controlling the operation of hydraulic cylinders and comprising:
   - a control housing,
   - a manually operable lever,
   - a support member housed in said control housing and having a supporting surface,
   - a pivot member rigidly connected to the lower end of said lever and supported on said supporting surface of said support member for rocking movement from a neutral position in a first pivotal direction and in a second pivotal direction transverse to said first direction, and said pivot member having a plurality of sides,
   - a first cable attached to one side of said pivot member, said cable being adapted to be operably connected to a first hydraulic cylinder and for actuating that hydraulic cylinder in response to pivotal movement of said lever and said pivot member in said first direction, and
   - a second cable attached to another side of said pivot member transverse to said one side of said pivot member, said second cable being adapted to be operably connected to a second hydraulic cylinder and for actuating that hydraulic cylinder in response to pivotal movement of said lever and said pivot member in said second direction.

2. A single lever control mechanism as set forth in claim 1 and further including an electrically driven pump operably connected to said hydraulic cylinders and switch means for actuating said electrically driven pump, said switch means including a fixed contact and a movable contact supported on said pivot member, said movable contact selectively engageable with said fixed contact when said pivot member is moved from said neutral position to a second position.

3. A single lever control mechanism as set forth in claim 1 wherein said housing includes an upper wall, and further including means for biasing said pivot member to said neutral position including a helical compression spring between said upper wall and said pivot member.

4. A single lever control mechanism as set forth in claim 1 wherein said control housing includes an upper wall including a cruciform opening defined by intersecting slots, said lever extending through said cruciform opening and being slidably movable in said slots, and further including means for selectively preventing movement of said lever including a locking spool supported on said lever for slideable longitudinal movement from a first position spaced from said upper wall wherein said lever is freely movable in said slots to a second position wherein at least a portion of said spool is housed in said slots.

5. A single lever control mechanism for controlling the operation of hydraulic cylinders and comprising:
   - a control housing,
   - a manually operable lever, a pivot post supported in said control housing and having an upwardly extending free end, a pivot member rigidly connected to the lower end of said lever and supported on said upper end of said post for rocking movement from a neutral position in a first pivotal direction and in a second pivotal direction transverse to said first direction, and said pivot member having a plurality of sides, a first cable attached to one side of said pivot member, said cable being adapted to be operably connected to a first hydraulic cylinder and for actuating that hydraulic cylinder in response to pivotal movement of said lever and said pivot member in said first direction, and a second cable attached to another side of said pivot member transverse to said one side of said pivot member, said second cable being adapted to be operably connected to a second hydraulic cylinder and for actuating that hydraulic cylinder in response to pivotal movement of said lever and said pivot member in said second direction.

6. A single lever control mechanism as set forth in claim 5 and further including an electrically driven pump operably connected to said hydraulic cylinders and switch means for actuating said electrically driven pump, said switch means including a fixed contact and a movable contact supported on said pivot member, said movable contact selectively engageable with said fixed contact when said pivot member is moved from said neutral position to a second position.

7. A single lever control mechanism as set forth in claim 6 wherein said fixed contact includes an electrically conductive collar at least partially surrounding said pivot post and wherein said movable contact includes a plurality of contact fingers extending downwardly from a plurality of sides of said pivot member, said contact fingers selectively engaging said collar when said pivot member is pivoted from said neutral position.

8. A single lever control mechanism as set forth in claim 5 wherein said pivot post includes a rounded convex end supporting said pivot member and said pivot member includes a lower surface having a recess housing said convex end of said pivot member.

9. A single lever control mechanism as set forth in claim 5 wherein said housing includes an upper wall, and further including means for biasing said pivot member to said neutral position including a helical compression spring between said upper wall and said pivot member.

10. A single lever control mechanism as set forth in claim 5 wherein said control housing includes an upper wall having a cruciform opening defined by intersecting slots, said lever extending through said cruciform opening and being slidably movable in said slots, and further including means for selectively preventing movement of said lever including a lock spool supported on said lever for slidable longitudinal movement from a first position spaced from said upper wall wherein said lever is freely movable in said slots to a second position wherein at least a portion of said spool is housed in said slots.

11. In combination, a plow blade, means for controlling vertical movement of the plow blade including a first hydraulic cylinder, means for controlling lateral pivotal movement of the plow blade including a second hydraulic cylinder, means for supplying hydraulic fluid to said hydraulic cylinders including a fluid pump and means for actuating said pump including an electric motor, and a single lever control mechanism for controlling the operation of said hydraulic cylinders and comprising:

a control housing, a manually operable lever, a pivot post supported in said control housing and having an upwardly extending free end, a pivot member rigidly connected to the lower end of said lever and supported on said upper end of said post for rocking movement from a neutral position in a first pivotal direction and in a second pivotal direction transverse to said first direction, and said pivot member having a plurality of sides, a first cable attached to one side of said pivot member, said cable being operably connected to said first hydraulic cylinder for actuating that hydraulic cylinder in response to pivotal movement of said lever and said pivot member in said first direction, and a second cable attached to another side of said pivot member transverse to said one side of said pivot member, said second cable being operably connected to said second hydraulic cylinder for actuating that hydraulic cylinder in response to pivotal movement of said lever and said pivot member in said direction.

12. The combination set forth in claim 11 wherein said single lever control mechanism further includes switch means for actuating said electrically driven pump, said switch means including a fixed contact, and including a movable contact supported on said pivot member, said movable contact selectively engageable with said fixed contact when said pivot member is moved from said neutral position to a selected position.

13. The combination set forth in claim 12 wherein said fixed contact includes an electrically conductive collar surrounding said pivot post, and wherein said movable contact includes a plurality of contact fingers extending downwardly from a plurality of sides of said pivot member, said contact fingers selectively engaging said collar when said pivot member is pivoted from said neutral position.

14. The combination set forth in claim 11 wherein said pivot post includes a rounded convex end supporting said pivot member, and wherein said pivot member includes a lower surface having a recess housing said convex end of said pivot member.

15. The combination set forth in claim 11 wherein said housing includes an upper wall and further including means for biasing said pivot member to said neutral position, said biasing means including a helical compression spring located between said upper wall and said pivot member.

16. The combination set forth in claim 11 wherein said control housing includes an upper wall including a cruciform opening defined by intersecting slots, said lever extending through said cruciform opening and being slidably movable in said slots and further including means for selectively preventing movement of said lever including a lock spool supported on said lever for slidable longitudinal movement from a first position spaced from said upper wall, wherein said lever is freely movable in said slots, to a second position wherein at least a portion of said spool is housed in said slots.

* * * * *